United States Patent [19]

Bennett et al.

[11] 4,436,608

[45] Mar. 13, 1984

[54] NARROW GAP GAS ELECTRODE ELECTROLYTIC CELL

[75] Inventors: William R. Bennett, North Olmsted; Thomas M. Clere, Willowick, both of Ohio

[73] Assignee: Diamond Shamrock Corporation, Dallas, Tex.

[21] Appl. No.: 411,895

[22] Filed: Aug. 26, 1982

[51] Int. Cl.[3] ..... C25B 9/02; C25B 11/03

[52] U.S. Cl. ..... 204/265; 204/266; 204/283; 204/279

[58] Field of Search ..... 204/263–266, 204/282–284, 279

[56] References Cited

U.S. PATENT DOCUMENTS

| | | | |
|---|---|---|---|
| 3,616,442 | 10/1971 | Cheng et al. | 204/265 X |
| 3,864,236 | 2/1975 | Lindstrom | 204/265 |
| 4,260,469 | 4/1981 | McIntyre et al. | 204/265 |
| 4,271,003 | 6/1981 | Lindstrom | 204/265 |
| 4,340,459 | 7/1982 | McIntyre et al. | 204/258 |
| 4,376,691 | 3/1983 | Lindstrom | 204/283 X |

*Primary Examiner*—Donald R. Valentine

*Attorney, Agent, or Firm*—Woodrow W. Ban; Bruce E. Harang

[57] ABSTRACT

A gas-diffusion electrode cell having an electrolyte feed/withdrawal means integral to a frame for the electrode. The integral feed means for electrolyte feed/-withdrawal allows a reduced spacing between the gas-diffusion electrode and a separator in the cell, resulting in a lower operational voltage for electrolysis operation.

5 Claims, 5 Drawing Figures

NARROW GAP GAS ELECTRODE ELECTROLYTIC CELL

FIELD OF THE INVENTION

This invention relates to electrolytic cells, and more particularly the electrochemical cells employing a gas-diffusion electrode. Specifically, this invention relates to electrochemical cells employing so-called oxygen cathodes for the production of, particularly, chlorine and caustic soda.

BACKGROUND OF THE INVENTION

In many conventional electrolytic cells, a separator is affixed between anode and cathode within the cell, defining anode and cathode compartments within the electrolytic cell. Generally, differing electrolytes are present in each of these compartments, the electrolytes being generally related to reactions occurring at the particular electrode present in that compartment. For example, in a chlor alkali cell, an alkali metal chloride salt brine electrolyte is present in the anode compartment as an anolyte, and a solution of hydroxide of the alkali metal is present in the cathode compartment as a catholyte. Depending upon the hydraulic permeability of the separator, the catholyte can also include quantities of the alkali metal chloride salt.

In such chlor alkali cells, chlorine generally is evolved from the brine at the anode, while, in many cells, hydrogen gas is evolved at the cathode resulting from the decomposition of water to form hydroxyl groups that react with alkali metal ions crossing the separator in transmitting electrical current between anode and cathode. In one particular type of cell, a so-called oxygen cathode cell, oxygen is present with an electrocatalytic material at the cathode, and the oxygen combines with hydrogen ions being evolved to reform water. The energy associated with forming gaseous $H_2$ is thereby avoided, resulting in substantial power savings in operation of the cell.

In a typical oxygen cathode type cell, the anode and the oxygen cathode are retained individually within separate frames. These frames separated by the separator generally define anode and cathode compartments for electrolyte retention. Where the separator is a membrane, the membrane is retained between the frames. Where the separator is a porous separator, it may be retained between the frames or separately supported. Where a separator is retained between the frames, it is often separated from the frames by a gasketing material.

In a typical oxygen cathode cell, a sheet like cathode is retained upon the cathode frame. Catholyte contacts one surface of the cathode, with an oxygen containing gas contacting the other surface of the cathode. The oxygen containing gas typically is introduced through passages contained in the cathode frame, and gas depleted in oxygen content similarly removed.

Catholyte typically is introduced and removed through a catholyte feed frame. This catholyte feed frame generally is positioned between the separator and cathode frame, and effectively spaces the cathode and separator one from the other. This spacing contributes to an elevated voltage in operating the cell due to a resistance voltage drop due to electrical current passing through catholyte occupying this spacing within the cell. Could this spacing attributable to the thickness of a cathode feed frame be eliminated or reduced, considerable voltage savings could be achieved in the operation of the electrochemical cell.

DISCLOSURE OF THE INVENTION

The present invention provides an improvement to a gas-diffusion electrode type electrolytic cell. A gas-diffusion electrode cell embodying the invention includes anode and cathode compartments defined by a cell separator. A gas-diffusion electrode is positioned within at least one of the compartments. Electrolyte is contained within the compartment and contacts surface of the gas-diffusion electrode and surface of the separator. A gas including a component for reaction at the gas-diffusion electrode is contained within the cell structure in contact with a surface of the gas-diffusion electrode.

The improvement comprises an electrode frame wherein the gas-diffusion electrode is retained upon the frame. The frame includes integral passages for introducing the gas adjacent a second surface of the gas-diffusion electrode and for removing the gas, and separate, integral passages for introducing the electrolyte into contact and/or for removing electrolyte from contact with the first surface of the gas-diffusion electrode. In the preferred embodiment, the gas-diffusion electrode retained upon the cathode frame is spaced from the cell separator by only the thickness of a gasket. Where the separator is a porous diaphragm, the gas-diffusion electrode need not be spaced from the separator except by a sufficient distance to permit electrolyte removal and introduction.

In preferred embodiments, the gas-diffusion electrode is an oxygen cathode employed in a chlor alkali cell. The separator can be either a porous diaphragm or a cation permeable membrane. Spacing between the separator and oxygen cathode is maintained sufficient for flow of catholyte into and out of the contact with the cathode.

Utilizing the cathode frame of the improved electrolytic cell of the instant invention, a cathode feed frame interposed between the separator and cathode frames can be eliminated resulting in a decreased spacing between oxygen cathode and the separator. This elimination effectively reduces spacing between the anode and cathode within the cell, permitting operation at a reduced voltage, and resulting in substantial power savings in operation of the cell.

The above and other features and advantages of the invention will become more apparent in view of the description of preferred embodiments considered in conjunction with drawings which follow and together form a part of the specification.

BEST EMBODIMENT OF THE INVENTION

Figure 1:
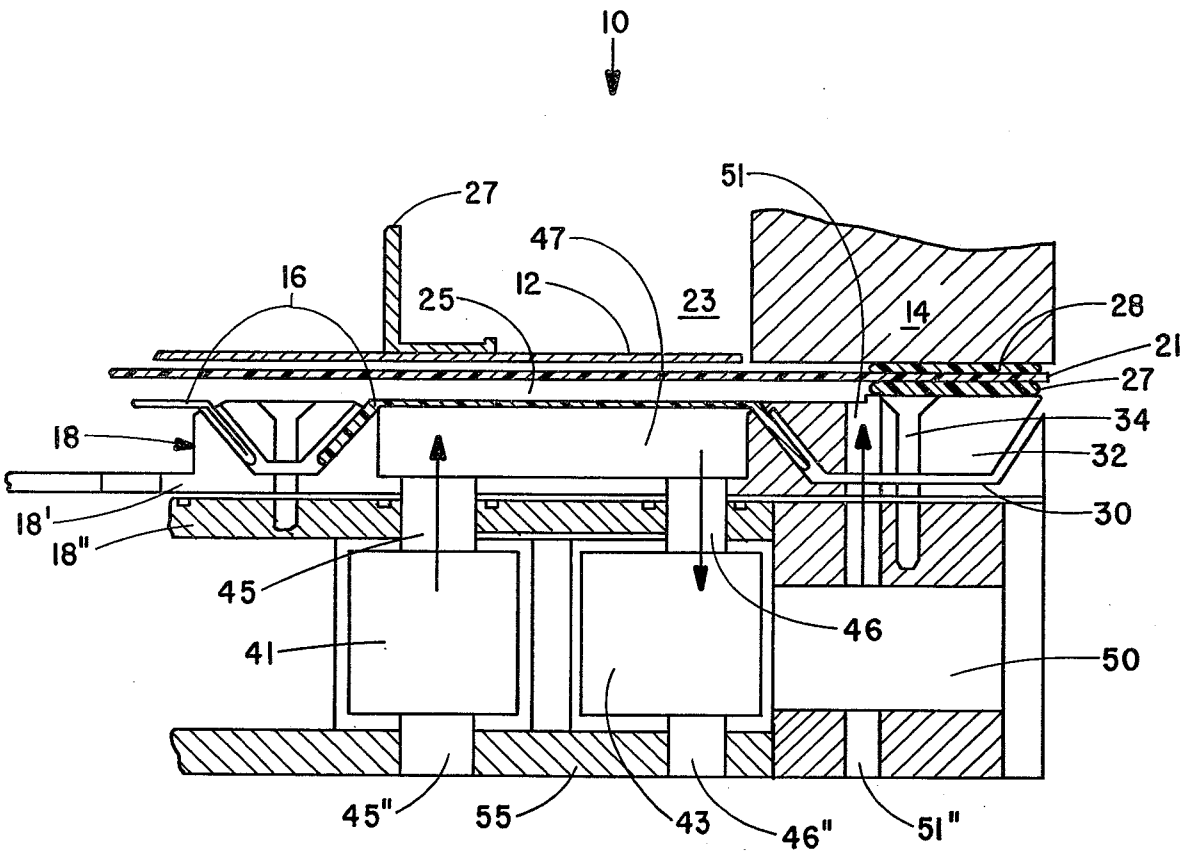
FIG. 1 is a partial cross-sectional elevation view taken on an edge of an improved cell of the instant invention.

Referring to the drawings, FIG. 1 shows a partial cross-sectional representation of a configuration, taken on edge, of a cell 10 embodying a narrow gap oxygen cathode construction. The cell includes an anode 12 retained within an anode frame 14 and an oxygen cathode 16 retained within a cathode frame 18. The frames 14, 18 are separated one from the other by a separator 21. The separator functions 21 to define anode and cathode compartments 23, 25, respectively, within the cell.

The anode can be of any suitable or conventional type useful in the electrolysis of halogen from an aqueous salt brine. Typically, such an anode will be of a foraminous nature, fabricated from a valve or passivating refractory metal such as titanium as is well known in the art.

Such an anode typically also includes a suitable or conventional electrocatalyst such as a platinum group metal oxide, that is an oxide of platinum, rhodium, iridium, osmium, ruthenium, and palladium, perhaps mixed with an oxide of a valve or passivating refractory metal such as titanium, zirconium, hafnium, tungsten, tantalum, niobium, vanadium, and aluminum. Suitable anode materials are well known in the practice of chlor alkali production, for example.

The anode also includes at least one electrically conductive support conductor bar 27 as is well known in the practice of electrolytic cell technology. Likewise, the anode frame 14, generally of tubular form, is fabricated of well-known materials in accordance with acceptable practices within the electrolytic cell industry, the materials of construction being capable of withstanding corrosive effects of contents of the anode compartment.

The separator 21 can be of any suitable or conventional type, and may be either hydraulically permeable, or substantially hydraulically impermeable, that is either a diaphragm or a membrane. If a diaphragm, the diaphragm may be of any suitable or conventional type as is well known in the art of electrolytic cells. Where, as in this best embodiment, the cell is one producing a halogen such as chlorine from a brine of a salt of the halogen, the diaphragm is one principally comprised of asbestos fibers, and possibly including a suitable or conventional strengthening binder such as polytetrafluoroethylene fibers, coadhered, or zirconium or titanium oxides.

If a membrane, the membrane is preferably one readily passing cations, but substantially resistant to the movement of other chemical species such as hydroxyl anions or radicals. One suitable membrane is comprised of a perfluorocarbon copolymer. Typically such perfluorocarbon is available in sheet form having particular functional groups capable of imparting cation exchange functionality; alternatively, the perfluorocarbon is available in a so-called intermediate form having generally functional groups relatively readily converted to functional groups capable of imparting cation exchange properties to the perfluorocarbon.

The intermediate polymer is prepared from at least two monomers that include fluorine substituted sites. At least one of the monomers comes from a group that comprises vinyl fluoride, hexafluoropropylene, vinylidene fluoride, trifluoroethylene, chlorotrifluoroethylene, perfluoro(alkyl vinyl ether), tetrafluoroethylene and mixtures thereof.

At least one of the monomers comes from a grouping having members with functional groups capable of imparting cationic exchange characteristics to the final copolymer. Monomers containing pendant sulfonyl, carbonyl or, in some cases phosphoric acid based functional groups are typical examples. Condensation esters, amides or salts based upon the same functional groups can also be utilized. Additionally, these second group monomers can include a functional group into which an ion exchange group can be readily introduced and would thereby include oxyacids, salts, or condensation esters of carbon, nitrogen, silicon, phosphorus, sulfur, chlorine, arsenic, selenium, or tellurium.

Among the preferred families of monomers in the second grouping are sulfonyl and carbonyl containing monomers containing the precursor functional group $SO_2F$ or $SO_3$ alkyl, COF or $CO_2$ alkyl. Examples of members of such a family can be represented by the generic formula of $CF_2{=}CFSO_2F$ and $CF_2{=}CFR_1SO_2F$ where $R_1$ is a bifunctional perfluorinated radical comprising usually 2 to 8 carbon atoms but reaching 25 carbon atoms upon occasion.

The particular chemical content or structure of the perfluorinated radical linking the sulfonyl group to the copolymer chain is not critical and may have fluorine, chlorine or hydrogen atoms attached to the carbon atom to which the sulfonyl or carbonyl based group is attached, although the carbon atom to which the sulfonyl or carbonyl based group is attached must also have at least one fluorine atom attached. Preferably the monomers are perfluorinated. If the functional group is attached directly to the chain, the carbon in the chain to which it is attached must have a fluorine atom attached to it. The $R_1$ radical of the formula above can be either branched or unbranched, i.e., straight chained, and can have one or more ether linkages. It is preferred that the vinyl radical in this group of sulfonyl or carbonyl fluoride containing comonomers be joined to the $R_1$ group through an ether linkage, i.e., that the comonomer be of the formula $CF_2{=}CFOR_1X$ where X is COF or $SO_2F$. Illustrative of such sulfonyl fluoride containing comonomers are:

$$CF_2{=}CFOCF_2CF_2SO_2F,\ CF_2{=}CFOCF_2\underset{\underset{CH_3}{|}}{C}FOCF_2CF_2SO_2F,$$

$$CF_2{=}CFOCF_2\underset{\underset{CF_3}{|}}{C}FOCF_2\underset{\underset{CF_3}{|}}{C}FOCF_2CF_2SO_2F,$$

$$CF_2{=}CFCF_2CF_2SO_2F,\ \text{and}\ CF_2{=}CFOCF_2\underset{\underset{\underset{\underset{CF_3}{|}}{O}}{\underset{CF_2}{|}}}{C}FOCF_2CF_2SO_2F$$

The corresponding esters of the aforementioned sulfonyl and carbonyl fluorides are equally preferred.

While the preferred intermediate copolymers are perfluorocarbon, that is perfluorinated, others can be utilized where there is a fluorine atom attached to the carbon atom to which the sulfonyl or carbonyl group is attached. A highly preferred copolymer is one of tetrafluoroethylene and perfluoro(3,6-dioxa-4-methyl-7-octenesulfonyl fluoride) comprising between 10 and 60 weight percent, and preferably between 25 and 40 weight percent, of the latter monomers.

These perfluorinated copolymers may be prepared in any of a number of well-known manners such as is shown and described in U.S. Pat. Nos. 3,041,317; 2,393,967; 2,559,752 and 2,593,583.

An intermediate copolymer is readily transformed into a copolymer containing ion exchange sites by conversion of the sulfonyl or carbonyl groups (—$SO_2F$ or —$SO_3$ alkyl and COF or $CO_2$ alkyl) to the form —$SO_3Z$ or $CO_2Z$ by saponification or the like wherein Z is hydrogen, an alkali metal, an amine, an ammonium ion or salt, or an alkaline earth metal. The converted copolymer contains sulfonyl or carbonyl group based ion exchange sites contained in side chains of the copolymer and attached to carbon atoms having at least one attached fluorine atom. Not all sulfonyl or carbonyl groups within the intermediate copolymer need be converted. The conversion may be accomplished in any suitable or customary manner such as is shown in U.S. Pat. Nos. 3,770,547 and 3,784,399.

A separator made from copolymeric perfluorocarbon having sulfonyl based cation exchange functional groups possesses a relatively low resistance to back migration of sodium hydroxide from the cathode to the anode, although such a membrane successfully resists back migration of other caustic compounds such as KOH. Certain membrane configurations utilize adjacent layers of perfluorocarbon, one layer having pendant carbonyl derived functionality and the other layer having pendant sulfonyl derived functionality. The carbonyl derived layer of functionality provides additional resistance to back migration but also provides additional resistance to desired cation migration. The layering with perfluorocarbon having sulfonyl derived pendant functionality allows the carbonyl layer to be fabricated to be desirably thin, resisting back migration, but only marginally interfering with desired cation movement without sacrificing structured membrane strength.

In one preferred embodiment, the sulfonyl derived zone alternately can contain perfluorocarbon containing pendant functional groups can be sulfonamide functionality of the form —$R_1SO_2NHR_2$ where $R_2$ can be hydrogen, alkyl, substituted alkyl, aromatic or cyclic hydrocarbon or a metal ion. Methods for providing sulfonamide based ion exchange membranes are shown in U.S. Pat. Nos. 3,969,285 and 4,113,585.

Copolymeric perfluorocarbon having pendant carboxylate cationic exchange functional groups can be prepared in any suitable or conventional manner such as in accordance with U.S. Pat. No. 4,151,053 or Japanese Patent Application 52(1977)38486 or polymerized from a carbonyl functional group containing monomer derived from a sulfonyl group containing monomer by a method such as is shown in U.S. Pat. No. 4,151,053. Preferred carbonyl containing monomers include $CF_2{=}CF{-}O{-}CF_2CF(CF_3)O(CF_2)_2COOCH_3$ and $CF_2{=}CF{-}O{-}CF_2CF(CF_3)OCF_2COOCH_3$.

Preferred copolymeric perfluorocarbons utilized in the instant invention therefore include carbonyl and/or sulfonyl based groups represented by the formula —$OCF_2CF_2X$ and/or —$OCF_2CF_2Y{-}O{-}YCF_2CF_2O$—wherein X is sulfonyl fluoride ($SO_2F$) carbonyl fluoride (COF) sulfonate methyl ester ($SO_2OCH_3$) carboxylate methyl ester ($COOCH_3$) sulfonamides of the general form ($R_1SO_2NHR_2$) ionic carboxylate ($COO^-Z^+$) or ionic sulfonate ($SO_3^-Z^+$), Y is sulfonyl or carbonyl (—$SO_2$——CO—) and Z is hydrogen, an alkali metal such as lithium, cesium, rubidium, potassium and sodium, an alkaline earth metal such as beryllium, magnesium, calcium, strontium, barium and radium, an amine or an ammonium ion or salt.

A membrane can be formed by any suitable or conventional means such as by extrusion, calendering, solution coating or the like. It may be advantageous to employ a reinforcing framework within the copolymeric material. This framework can be of any suitable or conventional nature such as TEFLON mesh or the like. Layers of copolymer containing differing pendant functional groups can be laminated under heat and pressure in well-known processes to produce a membrane having desired functional group properties at each membrane surface and throughout each laminate. For chlorine generation cells, such membranes have a thickness generally of between 1 mil and 150 mils with a preferable range of from 4 mils to 10 mils.

The equivalent weight range of the copolymer intermediate used in preparing the membrane is important. Where lower equivalent weight intermediate copolymers are utilized, the membrane can be subject to destructive attack such as dissolution by cell chemistry. When an excessively elevated equivalent weight copolymer intermediate is utilized, the membrane may not pass cations sufficiently readily, resulting in an unacceptably high electrical resistance in operating the cell. It has been found that copolymer intermediate equivalent weights should preferably range between about 1000 and 1500 for the sulfonyl based membrane materials and between about 900 and 1500 for the carbonyl based membrane materials.

The membrane 21 is generally retained between the anode frame 14 and the cathode frame 18, in compression. Any suitable or conventional retention means can be utilized. One or more gaskets 27, 28 are generally utilized for sealing and protecting the retained membrane, EPDM™, Hypalon™ or Neoprene™ being generally acceptable gasketing material, the latter two being marketed by E. I. duPont de Nemours and Company, Inc.

The cathode frame includes formed grooves 30 channels or notches that receive the oxygen cathode 16. A retainer 32 shaped for being received in the groove 30 is utilized for retaining the oxygen cathode in the groove thereby compressibly positioning and retaining the oxygen cathode upon the cathode frame. Suitable or conventional fastening means, such as machine, cap or socket screws 34 threadably received upon the cathode frame 18 for fastening the retainer 30 to the cathode frame 18.

The cathode frame includes at least one integral gas supply passage 41 and at least one integral gas return passage 43. As may be seen readily by reference to FIG. 1, these supply and return passages are arranged using integral gas flow channels 45, 46 to be in gas flow communication with a gas cathode chamber 47 integral to the cathode frame. Using the passages 41, 43, the channels 45, 46 and the chamber 47, oxygen containing gas can be introduced into contact with a surface of the oxygen cathode 16 and subsequently withdrawn. Generally a single passage 41, 43 will be serviced by a plurality of channels 45, 46.

The cathode frame 18 also includes at least one passage 50 and channel 51 for introduction and/or withdrawal of electrolyte in contact with the other surface of the oxygen cathode 16 from the cathode compartment 25. Typically a cathode frame will include a plurality of gas cathode chambers 47 and oxygen cathodes 16 serviced by a single cathode compartment 25. Electrolyte, if introduced using the passage 50 and channel 51, is generally withdrawn at an opposite end (not shown) of the cathode frame 18.

Figure 2B:
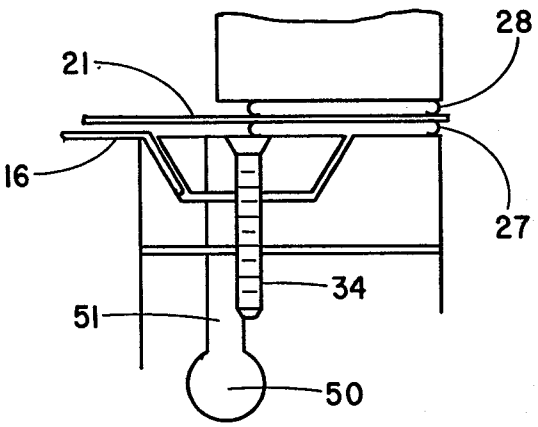
FIGS. 2*a* and 2*b* are cross-sectional representations of one configuration of electrolyte supply/withdrawal passages.
Figure 2A:
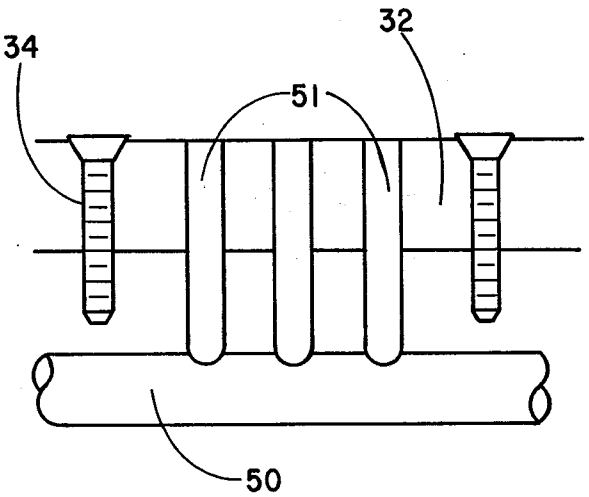
Figure 3B:
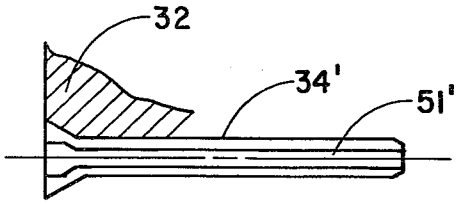
FIGS. 3*a* and 3*b* are cross-sectional representations of another configuration of electrolyte supply/withdrawal passage.
Figure 3A:
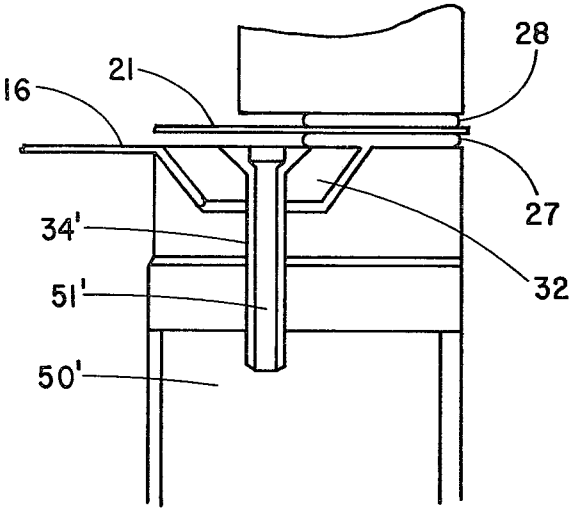

Referring to FIGS. 2*a* and 2*b*, it may be seen that a plurality of channels 51 can be utilized for servicing a single passage 50. Referring to FIGS. 3*a* and 3*b*, it may be seen that a screw 34 threadably received in the cathode frame can be hollowed to yield an electrolyte passage 51'.

For convenience, it is often desirable that the cathode frame 18 can be prepared in sections 18', 18" joined by suitable or conventional means for use as a cathode frame. Regardless of how prepared, the oxygen cathode 16 need be spaced from the separator 21 only by the thickness of a gasket 27, if used, or by a space sufficient to pass a requisite quantity of electrolyte. No separate feed frame for the electrolyte is required that would increase the distance between the oxygen cathode 16 and the separator 21.

The oxygen cathode can be of any suitable or conventional configuration. Typically, for a chlor alkali cell, the oxygen cathode is a laminate of a polytetrafluoroethylene wetproofing layer that opposes the electrolyte within the cathode compartment 25, and a catalytic layer usually including carbon particles often having an adsorbed metal catalytic compound, and polytetrafluoroethylene, optionally fibrillated. The oxygen cathode may also include an electrically conducting grid. While the cathode 16 may be formed as a sheet spanning the entire cathode frame 18, it may also be separated into a plurality of discrete sheetlets, each retained upon the cathode frame to cover a single gas chamber 47.

It should be apparent that a further oxygen cathode can be accommodated, positioned at 55 and supplied with gas and electrolyte vice channels 45",46", 51" as shown in FIG. 1. Where the diaphragm is porous or hydraulically permeable, it should be apparent that only an electrolyte withdrawal passage 50 and channels 51 may be required, electrolyte being supplied by flow of material from the anode compartment through the diaphragm. Equally where a membrane separator is employed, it may be desirable to provide a water addition to the cathode compartment 25 when operating a chlor alkali cell to provide an optimal electrolyte strength.

It should be apparent that the cell configuration can be reversed, providing a gas anode. In such an event, the spacing between the separator 21 and the gas anode may likewise be reduced employing the electrolyte passages of the instant invention integral to the electrode frame.

While a preferred embodiment of the invention has been shown and described in detail, it should be apparent that various modifications and alterations can be made thereto without departing from the scope of the claims that follow.

What is claimed is:

1. In a gas-diffusion electrode type electrolytic cell having anode and cathode compartments defined by a cell separator and having a gas-diffusion electrode positioned in at least one of the compartments spaced from the separator, electrolyte within the compartment being in contact with one surface of the gas-diffusion electrode and a reactant-containing gas being in contact with the other surface of said gas-diffusion electrode, the improvement comprising an electrode frame, said frame having a channel being formed circumferentially upon the electrode frame, at least the edge portions of said gas-diffusion electrode being received in said channel, said frame including at least one retainer received in said channel and at least one fastener for securing said retainer to said electrode frame thereby retaining the gas-diffusion electrode upon the electrode frame, said frame also including integral passages for maintaining the gas adjacent to one surface of said gas-diffusion electrode, and separate integral passages for maintaining electrolyte adjacent to the other surface of said gas-diffusion electrode.

2. In a gas-diffusion electrode type electrolytic cell having anode and cathode compartments defined by a cell separator and having a gas-diffusion electrode positioned in at least one of the compartments spaced from the separator, electrolyte within the compartment being in contact with one surface of the gas-diffusion electrode and a reactant-containing gas being in contact with the other surface of said gas-diffusion electrode, the improvement comprising an electrode frame, said frame having a channel being formed circumferentially upon the electrode frame, at least the edge portions of said gas-diffusion electrode being received in said channel, said frame including at least one retainer received in said channel and at least one fastener for securing said retainer to said electrode frame thereby retaining the gas-diffusion electrode upon the electrode frame, said frame also including integral passages for maintaining the gas adjacent to one surface of said gas-diffusion electrode, and separate integral passages for maintaining electrolyte adjacent to the other surface, further characterized in said fasteners being hollow and comprising at least a portion of the integral passages by which said electrolyte is maintained adjacent to said gas-diffusion electrode.

3. In an oxygen cathode type electrolytic cell having anode and cathode compartments defined by a cell separator, the cell having an oxygen cathode positioned in the cathode compartment spaced from the separator, a catholyte within the compartment in contact with one surface of the oxygen cathode and an oxygen containing gas in contact with the other surface of the cathode, the improvement comprising a cathode frame, said frame having a channel being formed circumferentially upon said frame, at least the edge portions of said oxygen cathode being received in said channel and said cathode frame including at least one retainer received in said channel and at least one fastener for securing said retainer to said cathode frame thereby retaining said oxygen gas cathode upon said cathode frame, said frame including integral passages for maintaining the oxygen containing gas adjacent to one surface of said oxygen cathode, and separate integral passages for maintaining catholyte adjacent the other oxygen cathode surface.

4. In an oxygen cathode type electrolytic cell having anode and cathode compartments defined by a cell separator, the cell having an oxygen cathode positioned in the cathode compartments spaced from the separator, a catholyte within the compartment in contact with one surface of the oxygen cathode and an oxygen containing gas in contact with the other surface of the cathode, the improvement comprising a cathode frame, said frame having a channel being formed circumferentially upon said frame, at least the edge portions of said oxygen cathode being received in said channel, and said cathode frame including at least one retainer received in said channel and at least one fastener for securing said retainer to said cathode frame thereby retaining said oxygen gas cathode upon said cathode frame, said frame including integral passages for maintaining the oxygen containing gas adjacent to one surface of said oxygen cathode, and separate integral passages for maintaining catholyte adjacent the other oxygen cathode surface, further characterized in having fasteners being hollow and comprising at least a portion of the integral passages by which said catholyte is maintained adjacent to said oxygen cathode.

5. The cell of any one of claims 1 or 2 or 3 or 4, wherein the thickness of a gasket provides the spacing between separator and gas-diffusion electrode within the cell.

* * * * *